US005947052A

United States Patent [19]

Deising

[11] Patent Number: 5,947,052

[45] Date of Patent: Sep. 7, 1999

[54] AUXILIARY WINDSHIELD

[76] Inventor: Norman U. Deising, P.O. Box 1157, Port Ewen, N.Y. 12466

[21] Appl. No.: 09/026,238

[22] Filed: Feb. 19, 1998

[51] Int. Cl.[6] ..... B63B 17/00

[52] U.S. Cl. ..... 114/361

[58] Field of Search ..... 114/343, 361; 296/96.11, 84.1, 95.1, 97.1

[56] References Cited

U.S. PATENT DOCUMENTS

| | | | |
|---|---|---|---|
| 897,195 | 2/1908 | Samuel . | |
| 2,739,834 | 3/1956 | Bryce | 296/96.11 |
| 2,816,795 | 12/1957 | Galloway | 296/96.11 |
| 3,363,937 | 1/1968 | Larson | 296/84 |
| 3,829,152 | 8/1974 | Hobbs | 296/78 |
| 4,621,859 | 11/1986 | Spicher | 298/78 R |
| 5,195,797 | 3/1993 | Hobbs | 296/77.1 |

*Primary Examiner*—Stephen Avila

[57] ABSTRACT

An Auxiliary Windshield for a variety of uses, but most specifically for use on a boat, where on occasion, due to weather or speed of operation, added windshield protection is beneficial. A clear plastic shield, which is break resistant, is used with a clamping means which retains the Auxiliary Windshield and by use of a knob can be secured to an existing structure such as an existing windshield. In an alternate embodiment, instead of an Auxiliary Windshield which is clamped in one position, the Auxiliary Windshield may be rotated to various positions. The clamping means includes a fixed arm and a pivot arm, the fixed arm and the pivot arm engaging one another by radial grooves, the pivot arm having the Auxiliary Windshield affixed thereto.

6 Claims, 8 Drawing Sheets

AUXILIARY WINDSHIELD

BACKGROUND OF THE INVENTION

1. Field of the Invention

This invention relates to windshields and more particular to an auxiliary windshield that can be added onto an existing structure such as a windshield already in place to provide added protection.

2. Description of the Prior Art and Objects of the Invention

Windshields are very well known. Virtually every motor vehicle made today and for a long time prior thereto has had a windshield. A windshield that can be easily secured in any number of applications such as construction sites can be beneficial. Such a windshield must be easily and quickly mounted and still be secure and through which one can see and still obtain protection from wind and precipitation. Boats, most specifically, frequently but not always have windshields but can, in specific situations of wind and high speed need added windshield protection. Hinged windshields are also known which can be turned down under certain conditions and returned to a position of protection as required and such hinged windshields are particularly important for boats.

The Samuel Patent, U.S. Pat. No. 879,195, teaches a windshield in two parts, a lower part inclined on a motor vehicle and an upper part permanently hinged to the lower part. A bolt is used to retain the upper part of the windshield at whatever angle to the lower part is desired.

In boating, a windshield may be required in a particular place on the boat but not necessarily at all times. In small motor boats, a wrap around wind shield is often permanently mounted on the boat. With passengers and an operator that are tall, frequently, the head, and thus the face of the persons in the boat, is above the windshield and in bad weather or during high speed operation, an added windshield above the original windshield serves a very useful purpose of diverting spray. However, at times such a windshield is not needed and the breeze on the occupants of the boat is desired. Therefore, to be able to turn the auxiliary windshield down or totally remove it is very beneficial. In bass fishing, in rough weather, an added windshield over the existing windshield on a bass fishing boat is most desirable. However, to be able either to remove the auxiliary windshield and store it in the boat or to turn in down, is also a benefit. It is essential, however, that such an auxiliary wind shield be easily and most definitely securely attached since the blowing off of such an auxiliary windshield during operation of a boat could be very serious.

Accordingly, it is an object of the present invention to provide an auxiliary windshield that can be easily and safely secured to a structure and can then be readily removed when not needed.

It is a further object of the present invention to provide an auxiliary windshield that may be securely pivoted to a position for storage when not in use.

It is a further object of the present invention to provide an auxiliary windshield that is economical to produce.

It is a further object of the present invention to provide an auxiliary windshield that can be used universally on a wide variety of structures.

Other objects and advantages of the present invention will become apparent to those of ordinary skill in the art as the description thereof proceeds.

SUMMARY OF THE INVENTION

The Auxiliary Windshield may be either secured in a fixed position or may be securely mounted and be pivotal so that the Auxiliary Windshield can be turned down, such as generally horizontally over the hood of a boat, and thus be stored without being removed.

A durable transparent sheet provides a shield. A pair of clamps are used to affix the shield to provide the Auxiliary Windshield. Where each one of the pair of clamps is located, an opening is formed in the auxiliary windshield. An outer block is placed against the inside of the shield. The outer block has a cylindrical protrusion on its outside surface which fits into the opening in the shield. An opening extends through the cylindrical protrusion at the center of the cylindrical protrusion and through the outer block. A washer, with an opening through it is located on the outside surface of the shield at the opening in the shield. A ferrule, which is internally threaded, is located in the opening in the outside pressure block. The ferrule has one flared end. The flared end rests against the inside surface of the outer block, which is the surface most remote from the shield. A bolt is located through the washer, with the head of the bolt engaging the washer, and is threaded into the ferrule. The bolt extends beyond the ferrule. The bolt causes the washer and the outer block to press against opposite sides of the shield. An inner block is located on the side of the outer block block opposite from the shield and engages the outer pressure block. The bolt extends through the inner block. An outer cushion is located between the outer block and the structure on which the shield is located and an inner cushion is located between the structure and the inner cushion. A knob, which has a threaded inner opening, engages the bolt and when tightened presses the inner block and inner cushion toward the outer block and outer cushion. In this way, the shield is secured to whatever structure is desired as a result of the inner cushion and the outer cushion being firmly presses against whatever structure is selected.

With the Auxiliary Windshield that may be rotated, a fixed arm is mounted on the outside of the outer block in place of the washer and the shield is notched to permit the outer pressure block to extend through it and not be clamped by it. The fixed arm includes a mounting section which is the part of the fixed arm mounted on the outer block. An offset section extends substantially at right angles from the mounting section and a cylindrical section extends from the offset section at the end of the offset section remote from the mounting section. The end of the cylindrical section has a circular surface which has radial grooved and the cylindrical section has an opening generally centrally located in it extending into from the radially grooved surface part way into the cylindrical section. The opening in the cylindrical section of the fixed arm is threaded.

A pivot arm has a mounting section affixed to the shield by means of a bolt and nut. The bolt is located through an opening in the shield and the nut is located on the opposite side of the shield. An offset section extends from the mounting section and has a cylindrical section at the end of the offset which aligns with the cylindrical section of the fixed arm and has a circular surface with matching radial grooves to mate with the radial grooves of the circular surface of the fixed arm. The cylindrical section of the pivot arm has an opening generally centrally located through it. A bolt with a knob at the end is placed through the opening in the cylindrical section of the pivot arm and is threaded into the opening in the cylindrical section of the fixed arm. By tightening down on the knob of the bolt, the grooved surfaces are brought together and are locked together preventing of the shield from rotating but when the bolt is loosened by turning the knob, the shield may be turned to another desired position.

DESCRIPTION OF THE DRAWINGS

The invention may be readily understood by referring to the accompanying drawings, in which.

DESCRIPTION OF THE PREFERRED EMBODIMENT

Figure 1:
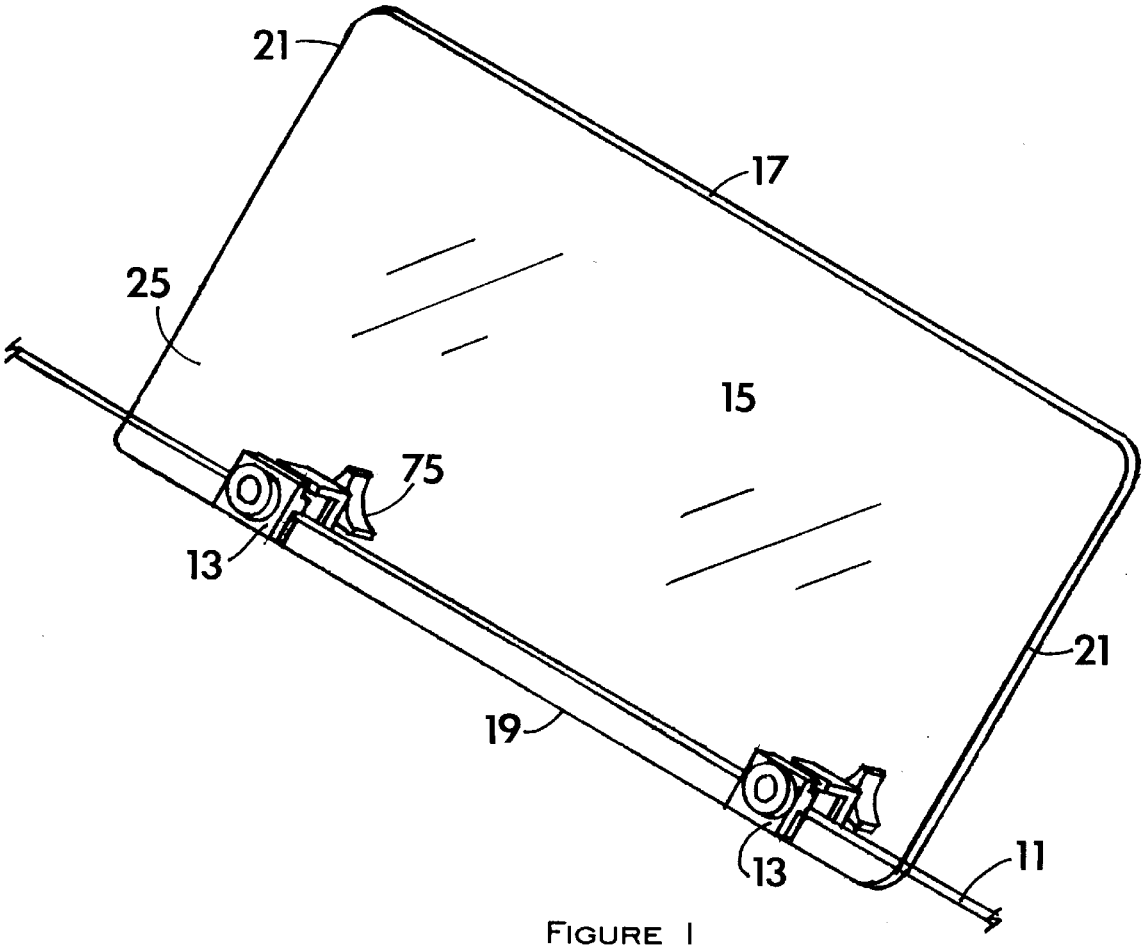
FIG. 1 is a pictorial view of the Auxiliary Windshield mounted on a structure with fixed clamps viewed from the outside.
Figure 2:
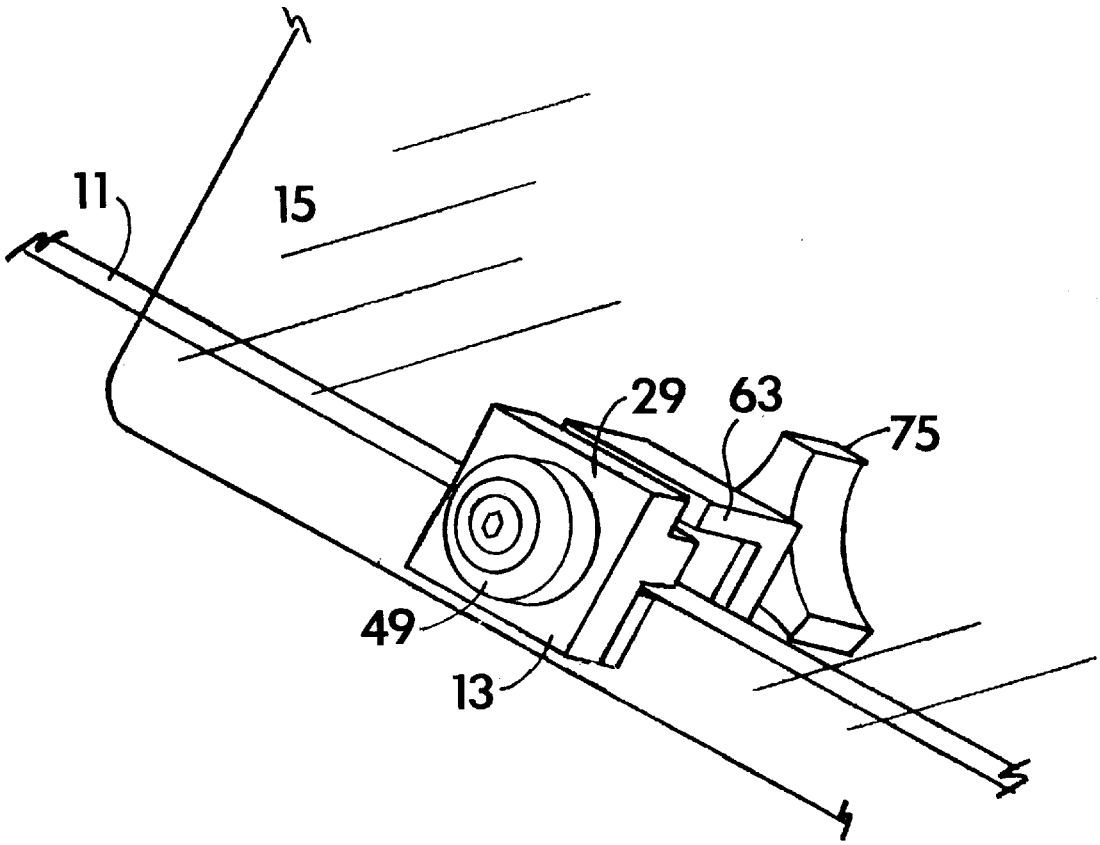
FIG. 2 is an enlarged pictorial view of a portion of the Auxiliary Windshield showing one fixed clamp mounted on a structure viewed from the outside.

Referring now to FIG. 1, an Auxiliary Windshield is shown mounted on a structure 11, which might be the existing windshield of a boat. FIG. 1 is viewed from outside of the windshield, the occupants who might use the Auxiliary Windshield being on the opposite side of the Auxiliary Windshield. It should be noted that the Auxiliary Windshield extends below the structure 11 on which it is mounted, resulting in an overlap, which is essential to avoid a gap though which wind and precipitation can pass. In FIG. 1, the fixed clamps 13 are shown, a pair of fixed clamps 13 being required to mount the Auxiliary Windshield. The Auxiliary Windshield with fixed clamps 13 cannot be rotated but by opening the fixed clamps 13 may be removed.

Figure 3:
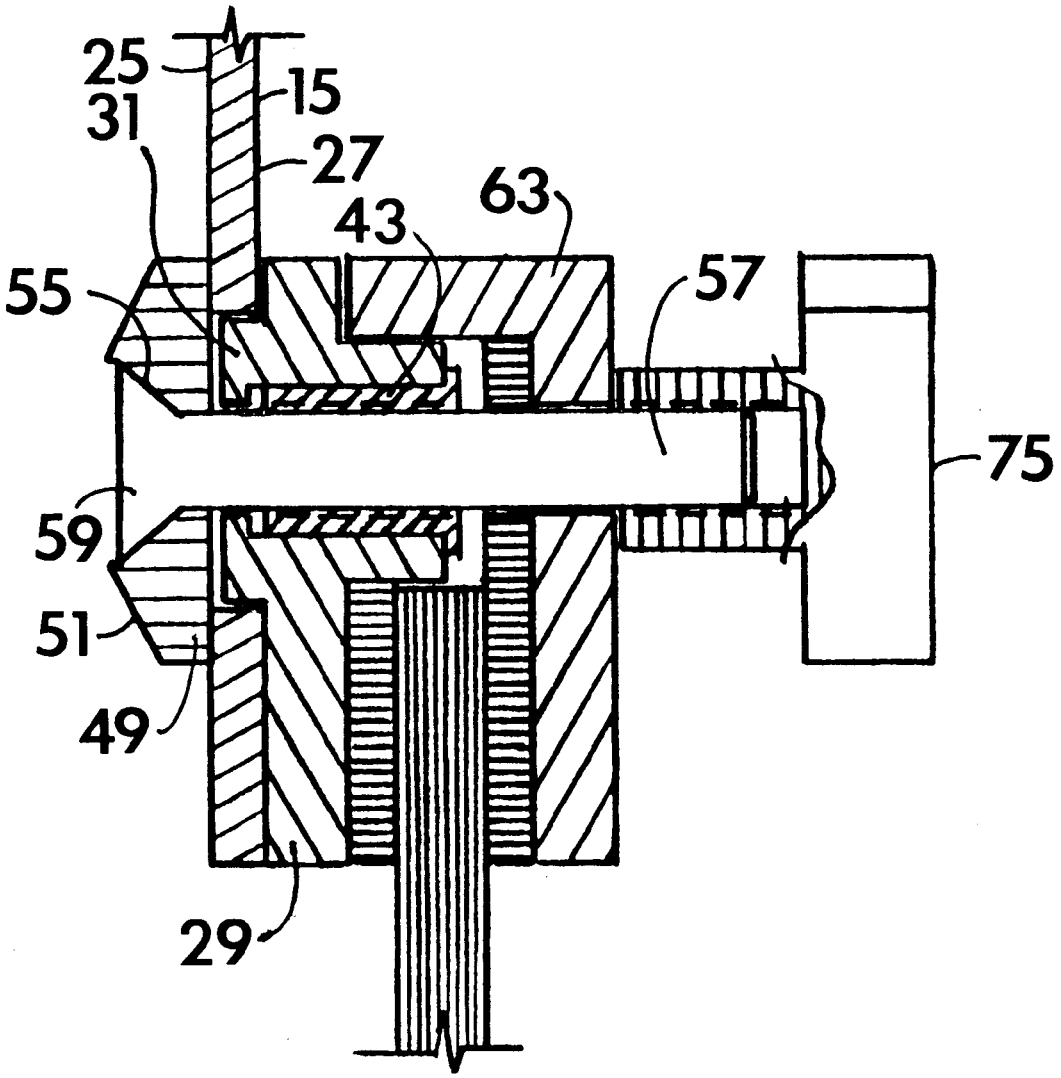
FIG. 3 is a cross-sectional view of a fixed clamp.
Figure 4:
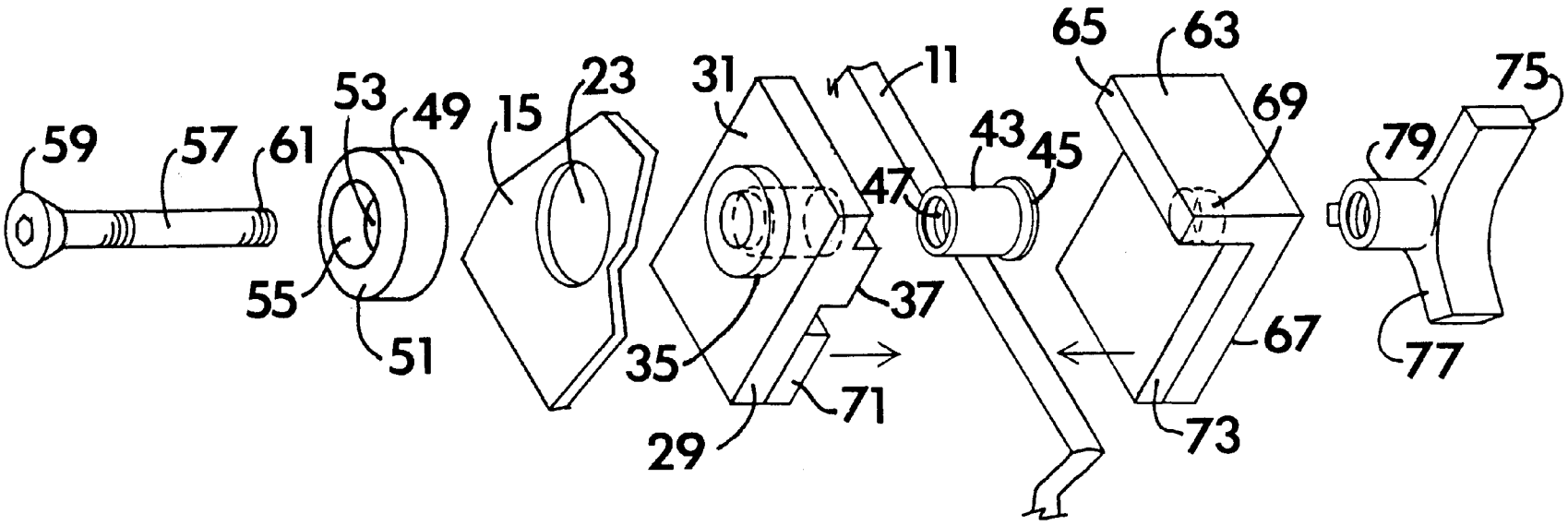
FIG. 4 is an exploded view of the fixed clamp.

In FIG. 3, the details of the fixed clamp 13 is shown. A shield 15, which is a durable, transparent sheet which, when combined with the fixed clamps 13, forms the Auxiliary Windshield, is shown in FIG. 3, secured within the fixed clamp 13. The shield 15 has a top edge 17 and a bottom edge 19 as well as two side edges 21. A pair of openings 23 are located along the bottom edge, one opening 23 at one side edge 21 and the other opening 23 at the opposite side edge 21. The fixed clamps 13 are mounted at the openings 23 and it should be understood that a pair of fixed clamps 13 are required for an Auxiliary Windshield.

The shield 15 also has an outside surface 25 and an inside surface 27. An outer block 29 is placed against the inside surface 27 of the shield 15. The outer block 29, which has an outside surface 31 and an inside surface 33 is rectangular but has a cylindrical protrusion 35 on the outside surface 31 generally at right angles to the outside surface 31. The cylindrical protrusion 35 extends from the outside surface 31 of the outer block 29 a distance slightly less than the thickness of the shield 15. The outer block 29 also has a rectangular protrusion 37 opposite the cylindrical protrusion 35 located on the inside surface 33 of the outer block 29.

The cylindrical protrusion 35 is fitted into one of the openings 23 in the shield 15. The outer block 29 has an opening 39 through it which is generally through the center 41 of the cylindrical protrusion 35 and the rectangular protrusion 37. The opening 39 in the outer block 29 is cylindrical and a ferrule 43 is placed in the opening 39. The ferrule 43 has a flared end 45 and the flared end 45 is retained against the rectangular protrusion 37 with the ferrule 43 extending from the flared end 45 into the cylindrical protrusion 35. The ferrule 43 has an inner thread 47.

A washer 49 is mounted against the outside surface 25 of the shield 15. The washer 49, which is cylindrical, has a beveled edge 51 on its outside surface and has an opening 53 through it, the opening 53 being generally located at the center of the washer 49. The opening 53 in the washer 49 has a taper 55 at the outside surface which reduces approximately to the size of the opening 39 through the outer block 29.

A bolt 57 is placed in the opening 53 in the washer 49 and into and through the opening 39 in the outer block 29. The bolt 57 has a sufficient length to extend beyond the outer block 29. The bolt 57 has a head 59 which is circular and tapered to engage the taper 55 in the opening 53 in the washer 49. The bolt 57 has a thread 61 which engages the inner thread 47 of the ferrule 43 and when the bolt 57 is tightly secured within the ferrule 43, the outer block 29 is drawn toward the washer 49. In this way, the shield 15 is secured between the washer 49 and the outer block 29.

An inner block 63 located adjacent the outside surface 31 of the outer block 29 and the rectangular protrusion 37 interacts with the outer block 29. The inner block 63 has two sections, namely a sliding section 65 and a contact section 67. The inner block 63 is L-shaped with the sliding section 65 and the contact section 67 being at substantially right angles to one another. The sliding section 65 rests on the rectangular protrusion 37. The contact section 67 has an opening 69 slightly larger than the inner thread 47 in the ferrule 43. The bolt 57 extends through the opening 69 in the contact section 67 of the inner block 63.

An outer cushion 71 is located beneath the rectangular protrusion 37 and against the outer block 29. An inner cushion 73 is located against the contact section 67 preferably against the entire contact section 67 and facing the outer cushion 71. Between the inner cushion 37 and the outer cushion 71, the structure 11, such as an existing windshield, is placed.

A knob 75 engages the bolt 57 at its end which is remote from the head 59 and the bolt 57 extends beyond the inner block 63. The knob 75 includes leverage spokes 77 and a cylindrical tube 79 affixed at the center of the spokes 77. The cylindrical tube 79 has an inner thread which engages the bolt 57. As the knob 75 is turned onto the bolt 57, the inner block 63 is pressed toward the outer block 29. As the inner block 63 is forced closer to the outer block 29, the structure 11 is pressed between the inner cushion 73 and the outer cushion 71.

Figure 7:
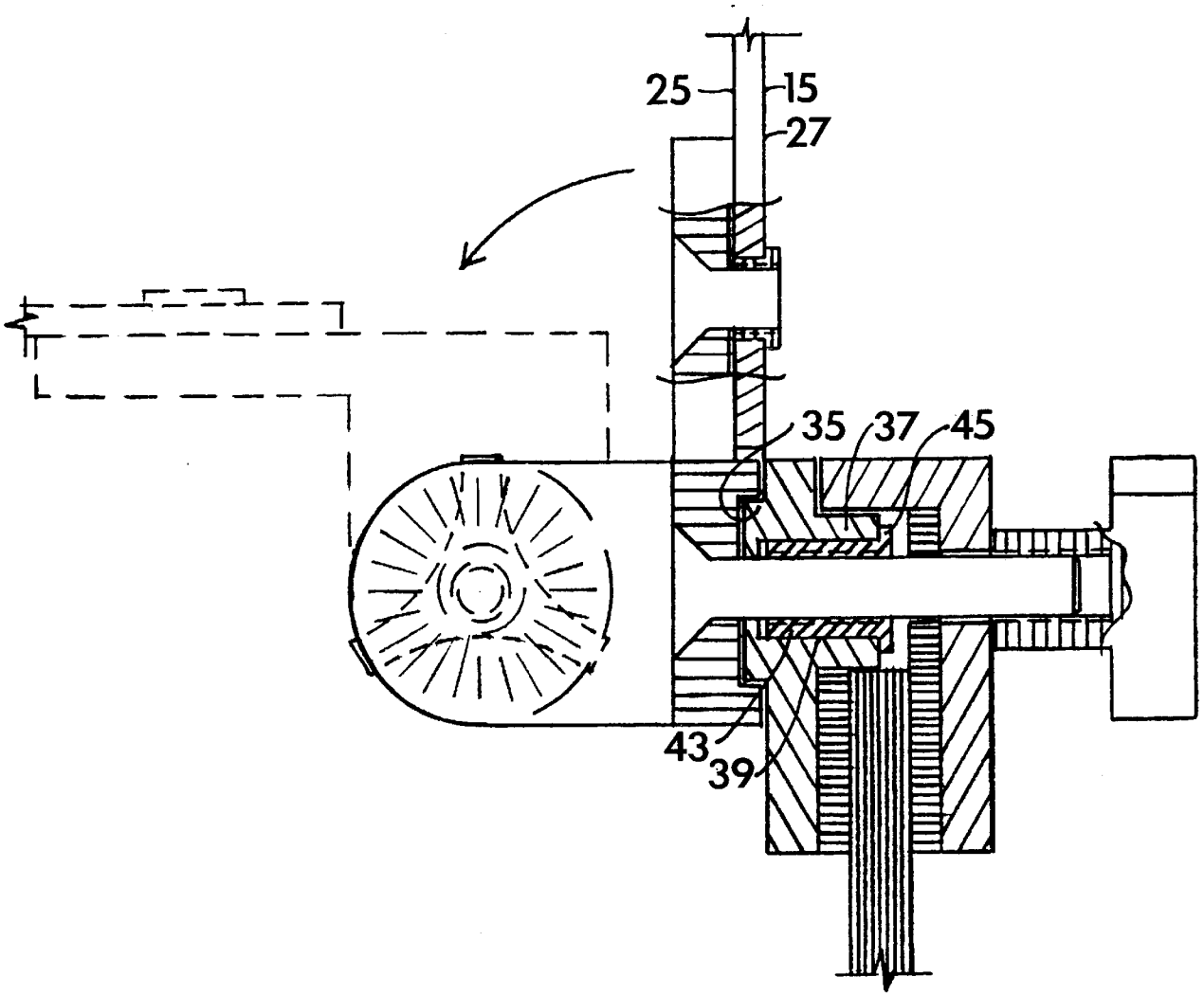
FIG. 7 is a cross-sectional view of a pivot clamp.
Figure 8:
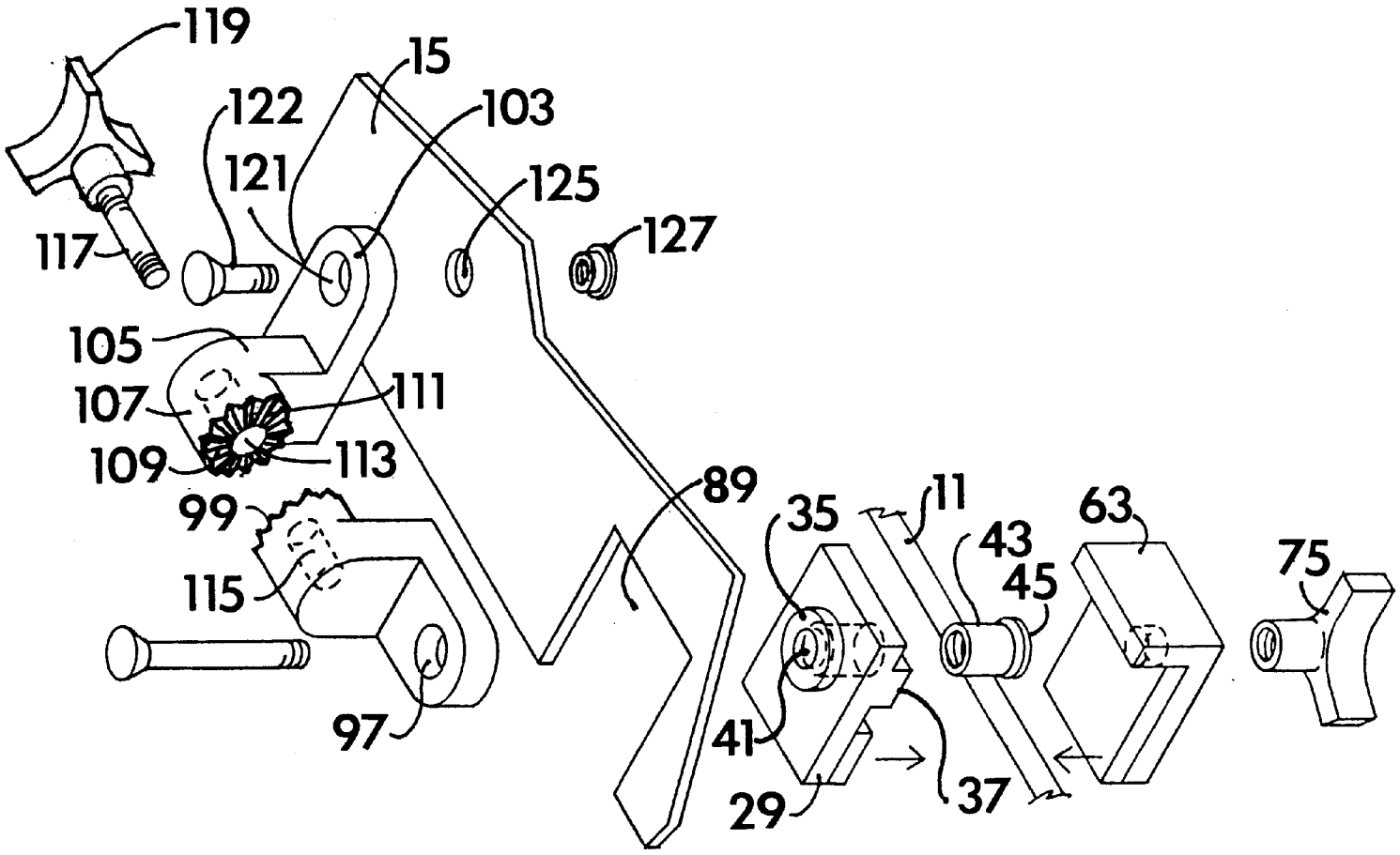
FIG. 8 is an exploded view of a pivot clamp.

In the alternate embodiment, shown in FIG. 7 and in FIG. 8, the Auxiliary Windshield is mounted on a pair of pivot clamps 81 and thus may be rotated so as to be turned down. As previously stated as to the fixed clamps 13, two pivot clamps 81 are required for an Auxiliary Windshield and the pivot clamps 81 are located generally in the same location on the shield 15 as the fixed clamps 13. Since the Auxiliary Windshield is subjected to high wind stress, the shield 15 must be secured against unwanted movement due to the forces of the wind. The pivot clamp 81 is an alternate embodiment but substantially includes the fixed clamp 13 as the fixed clamp 13 has been already described. The washer 49, however, is not used with the pivot clamp 81. Essentially, the washer 49 is replaced by a pair of arms 83, a fixed arm 85 and a pivot arm 87, the fixed arm 85 being affixed directly to the outer block 29 in place of the washer 49. Also, with the pivot clamps 81, the shield 15 has a cut-out 89, generally rectangular in shape, extending to the bottom edge 19 of the shield 15 so that the shield 15 is not held against the outer block 29. Instead, the shield 15 is secured to the pivot arm 87 as will be explained hereinafter and the fixed arm 85 is secured directly to the outer block 29.

The fixed arm 85 has three sections, namely a mounting section 95, an offset section 93 and a cylindrical section 95. The mounting section 91 has an opening 97 in it through which the bolt 57, as previously described, in relationship to the washer 49, is placed. In this way the fixed arm 85 is secured to the outer block 29. The offset section 93 is substantially at right angles to the mounting section 91 and extends away from the shield 15. The cylindrical section 95 extends from the offset section 93 substantially at right angles to the offset section 93. The cylindrical section 95, which is cylindrical, extends away from the mounting section 91 but the cylindrical section 95 is generally aligned with the mounting section 91. The cylindrical section 95 has a circular surface 99 remote from the offset section 93 at the end of the cylindrical section 95. The circular surface 99 has radial grooves 101 in it, the radial grooves 101 each having substantially the same width and depth.

The pivot arm 87 also has a mounting section 103 and an offset section 105 and a cylindrical section 107. The direction of the mounting section 103 of the pivot arm 87 is at right angles to the direction of the mounting section 91 of the fixed arm 85. In this way, the mounting section 91 of the fixed arm 85 lies generally horizontally on the shield 15 and the mounting section 91 of the pivot arm 87 is generally vertical on the shield 15. The offset section 105 of the pivot arm 87 extends generally at right angles to the mounting section 103 of the pivot arm 87. The offset section 105 of the pivot arm 87 and the offset section 93 of the fixed arm 85 generally lie in parallel planes.

The cylindrical section 107 of the pivot arm 87 is mounted on the offset section 105 of the pivot arm 87 but is directed in line with but in the opposite direction from the cylindrical section 95 of the fixed arm 85. The cylindrical section 107 of the pivot arm 87 also has a circular surface 109, essentially having the same diameter as the circular surface 99 of the cylindrical section 95 of the fixed arm 85. The circular surface 109 of the cylindrical section 107 of the pivot arm 87 also has radial grooves 111 that mate with the radial grooves 101 of the cylindrical section 95 of the fixed arm 85.

An opening 113 extends through the cylindrical section 107 of the pivot arm 87 which opening 113 is located generally at the center of the cylindrical section 107. An opening 115 is also located in the cylindrical section 95 of the fixed arm 85 and extends only part way into the cylindrical section 95 of the fixed arm 85. The opening 115 in the cylindrical section 95 of the fixed arm 85 is threaded. A bolt 117 is located in the opening 113 in the cylindrical section 107 of the pivot arm 87 and engages the thread in the cylindrical section 95 of the fixed arm 85. The bolt 117 has a knob 119 located at its end and when the knob 119 is turned, the two cylindrical sections 95, 107 are brought together locking the radial grooves 101, 111 into one another.

The mounting section 103 of the pivot arm 87 has a opening 121 through it. A bolt 123 is placed in the opening 121 and through an opening 125 in the shield 15. A nut 127 is affixed to the bolt 123 securing the pivot arm 87 to the shield 15.

Figure 5:
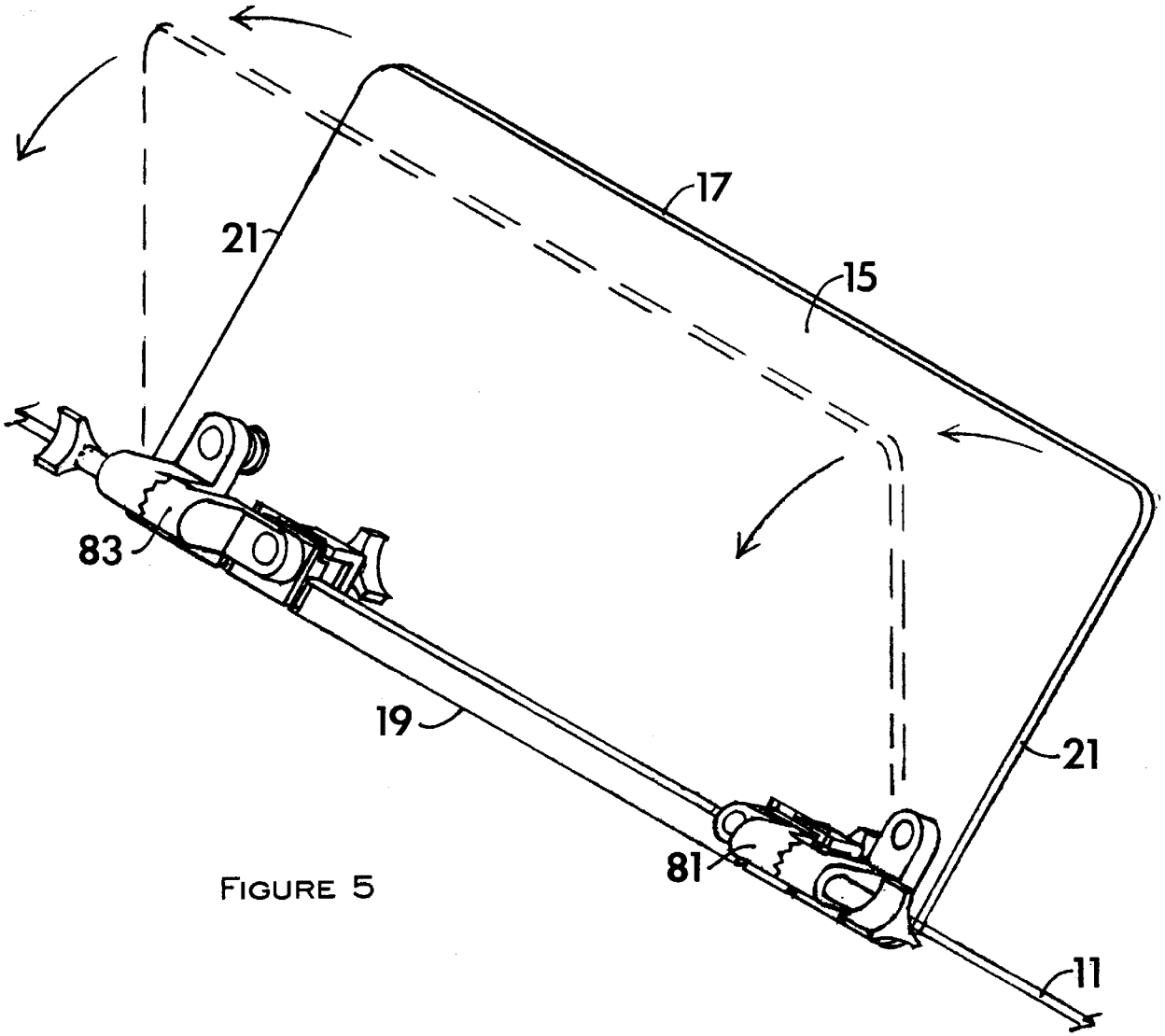
FIG. 5 is a pictorial view of the Auxiliary Windshield mounted on a structure with pivot clamps viewed from the outside.
Figure 6:
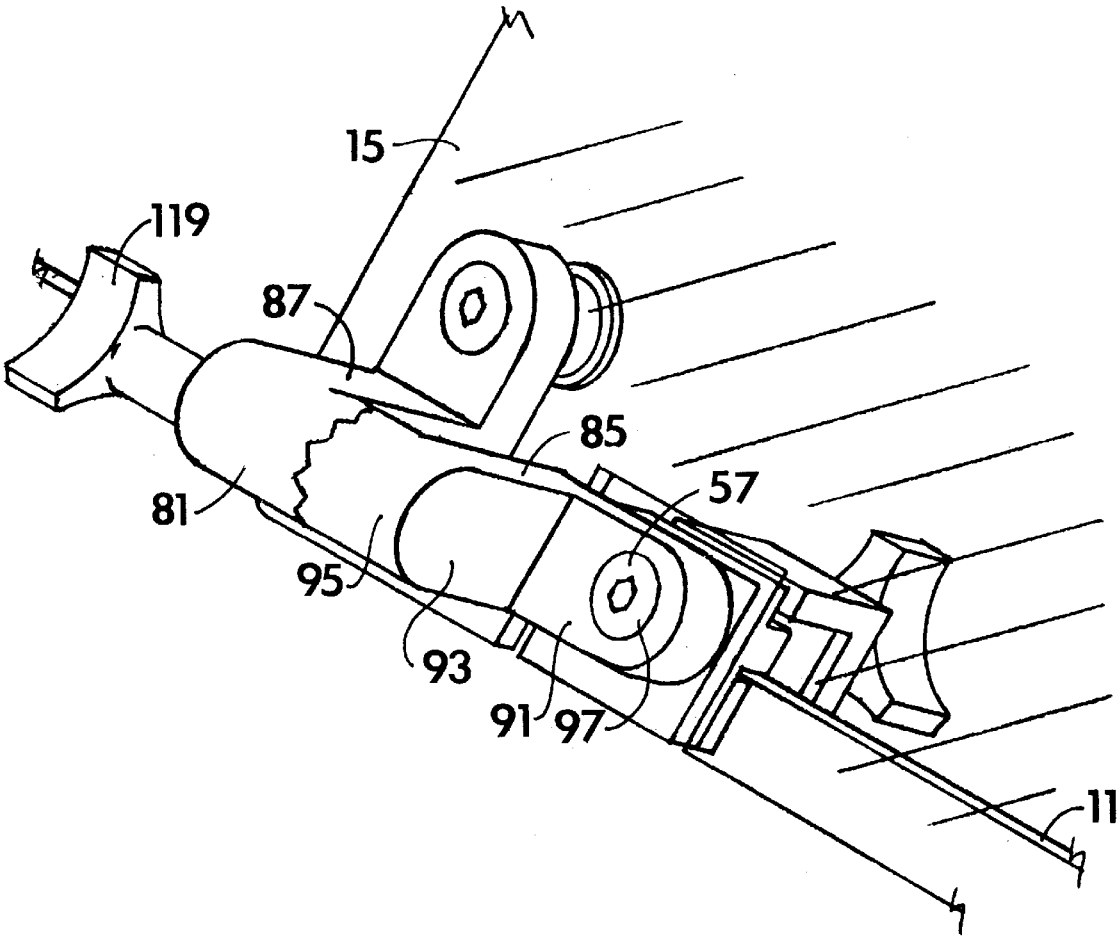
FIG. 6 is an enlarged pictorial view of a portion of the Auxiliary Windshield showing one pivot clamp mounted on a structure with pivot clamps viewed from the outside.

The pivot clamps are, as best seen in FIG. 5 are mirror images of one another and are located at opposite sides of the shield along the bottom edge of the shield.

Thus, while a preferred embodiment of the invention has been shown and described, it will be apparent to those skilled in the art that many other changes and modifications may be made without departure from the invention in its broader aspects. The appended claims are therefore intended to cover all such changes, and modifications as full within the true spirit and scope of the invention.

I claim:

1. An Auxiliary Windshield for attachment to a variety of structures such as an existing windshield of a boat, such Auxiliary Windshield comprising:

a shield having an outside surface and an inside surface and having two side edges, one edge on one side and an other edge on the other side, a top edge and a bottom edge, the shield being substantially transparent;

a pair of clamps mounted on the inside surface of the shield, each clamp including:

an outer block having an outer surface and an inner surface with a protrusion on the outer face, an opening being located through the outer block, an internal thread being located in the opening in the outer block;

mounting means for mounting the clamp on the shield;

a bolt, the bolt having a head, the head engaging the mounting means, the bolt engaging the inside thread in the outer block and extending beyond the outer block;

an inner block including a contact section, the contact section aligned with the inner surface of the outer block, the contact section having an opening in it, the bolt extending through the opening in the contact surface;

an inner cushion on the contact surface facing the outside surface of the outer block;

an outer cushion mounted on the inside surface of the outer block; and a knob having an inner thread, the inner thread mounted on the bolt and engaging the thread of the bolt and engaging the inner block.

2. An Auxiliary Windshield according to claim 1 wherein the mounting means includes a washer having a opening therein mounted on the outside surface of the shield, the bolt engaging the washer.

3. An Auxiliary Windshield according to claim 1 wherein the mounting means includes:

a pair of arms, the pair of arms being rotatable in relationship to one another; and means for retaining the pair of arms together.

4. An Auxiliary Windshield according to claim 1 wherein the mounting means includes:

a fixed mounting section having an opening therein, the bolt being in the opening in the fixed mounting plate, the bolt retaining the fixed mounting plate against the outer block;

a fixed cylinder having a circular surface, the circular surface of the fixed cylinder having radial grooves therein;

means for affixing the fixed cylinder to the fixed mounting plate with the fixed cylinder offset from the fixed mounting section;

a pivot mounting section;

means for securing the pivot mounting section to the outside surface of the shield;

a pivot cylinder having a circular surface, the circular surface of the pivot cylinder having radial grooves therein;

means for affixing the pivot cylinder to the pivot mounting plate with the pivot cylinder offset from the pivot mounting section, the circular surface of the pivot cylinder facing the circular surface of the fixed cylinder in close proximity; and means, including a bolt with a knob, for pressing the circular surface of the fixed cylinder and the circular surface of the pivot cylinder together.

5. An Auxiliary Windshield for attachment to a variety of structures such as an existing windshield of a boat, such Auxiliary Windshield comprising:

a shield having an outside surface and an inside surface and having two side edges, one edge on one side and an other edge on the other side, a top edge and a bottom edge, the shield being substantially transparent and having a pair of openings through it, one opening being adjacent the bottom edge and adjacent one edge on one side and the other opening being adjacent the bottom edge and adjacent the other edge on the other side;

a pair of fixed clamps mounted on the shield against the inside surface of the shield, one fixed clamp being located at one opening in the shield and the other shield being located at the other opening in the shield, each fixed clamp including:

an outer block having an outer surface and an inner surface and having a rectangular shape with a cylindrical protrusion on the outer face and a rectangular protrusion on the inner face, the cylindrical protrusion and the rectangular protrusion being opposite one another, an opening being located through the outer block, the opening being generally centrally located in the cylindrical protrusion and the rectangular protrusion, the rectangular protrusion having an upper surface, the cylindrical protrusion being located in an opening in the shield;

a ferrule having a flared end and having an inside thread, the ferrule being located within the opening in the outer block with the flared end against the rectangular protrusion;

a washer having an opening therein mounted on the outside surface of the shield;

a bolt, the bolt having a head to engage the washer, the bolt being located in the washer and through an opening in the shield and engaging the inside thread in the ferrule and extending beyond the outer block;

an inner block including a sliding section and a contact section, the sliding section engaging the upper surface of the rectangular protrusion of the outer block and the contact section aligned with the inner surface of the outer block, the sliding section and the contact section being located substantially at right angles to one another, the contact section having an opening in it, the bolt extending through the opening in the contact surface;

an inner cushion on the contact surface facing the outside surface of the outer block;

an inner cushion mounted on the inside surface of the outer block beneath the rectangular protrusion; and a knob having an inner thread mounted on the bolt and engaging the thread of the bolt and engaging the inner block.

6. An Auxiliary Windshield for attachment to a variety of structures such as an existing windshield of a boat, such Auxiliary Windshield comprising:

a shield having an outside surface and an inside surface and having two side edges, one edge on one side and an other edge on the other side, a top edge and a bottom edge, the shield being substantially transparent and having a pair of openings through it, one opening being adjacent the bottom edge and adjacent one edge on one side and the other opening being adjacent the bottom edge and adjacent the other edge on the other side;

a pair of fixed clamps mounted on the shield against the inside surface of the shield, one fixed clamp being located at one opening in the shield and the other shield being located at the other opening in the shield, each fixed clamp including:

an outer block having an outer surface and an inner surface and having a rectangular shape with a cylindrical protrusion on the outer face and a rectangular protrusion on the inner face, the cylindrical protrusion and the rectangular protrusion being opposite one another, an opening being located through the outer block, the opening being generally centrally located in the cylindrical protrusion and the rectangular protrusion, the rectangular protrusion having an upper surface, the cylindrical protrusion being located in an opening in the shield;

a ferrule having a flared end and having an inside thread, the ferrule being located within the opening in the outer block with the flared end against the rectangular protrusion;

a fixed arm including a fixed section, a fixed cylinder section and a fixed offset section, the fixed mounting section having an opening therein, the fixed cylinder section having a circular surface, the fixed circular surface having radial grooves, the fixed offset section being affixed to the fixed cylinder section and the fixed mounting section, the fixed cylinder section being held by the fixed offset section in a spaced relationship to the outside surface of the shield;

a pivot arm including a pivot mounting section, a pivot cylinder section having an opening therein, means for securing the pivot mounting section to the outside surface of the shield, the pivot cylinder section having a circular surface having radial grooves therein, the pivot offset section being affixed to the pivot cylinder section and the pivot cylinder section being held by the pivot offset section in a spaced relationship to the outside surface of the shield, the circular surface of the fixed cylinder section facing the circular surface of the pivot cylinder in close proximity;

means including a bolt with a knob for pressing the circular surface of the fixed cylinder and the circular surface of the pivot cylinder together;

a bolt, the bolt having a head to engage the opening in the fixed mounting section, the bolt being located in the fixed mounting section and through an opening in the shield and engaging the inside thread in the ferrule and extending beyond the outer block;

an inner block including a sliding section and a contact section, the sliding section engaging the upper surface of the rectangular protrusion of the outer block and the contact section aligned with the inner surface of the outer block, the sliding section and the contact section being located substantially at right angles to one another, the contact section having an opening in it, the bolt extending through the opening in the contact surface;

an inner cushion on the contact surface facing the outside surface of the outer block;

an outside cushion mounted on the inside surface of the outer block beneath the rectangular protrusion; and a knob having an inner thread mounted on the bolt and engaging the thread of the bolt and engaging the inner block.

* * * * *